US006070918A

United States Patent [19]

Calvache, Jr.

[11] Patent Number: 6,070,918

[45] Date of Patent: Jun. 6, 2000

[54] SLIDING DOOR/WINDOW SECURITY DEVICE

[76] Inventor: Manuel Calvache, Jr., 1118 Independence Dr., West Chester, Pa. 19382

[21] Appl. No.: 08/802,734

[22] Filed: Feb. 20, 1997

[51] Int. Cl.[7] ..... E05C 17/12

[52] U.S. Cl. ..... 292/DIG. 46; 292/DIG. 47

[58] Field of Search ..... 292/288, 289, 292/DIG. 20, DIG. 46, DIG. 47

[56] References Cited

U.S. PATENT DOCUMENTS

| | | | |
|---|---|---|---|
| D. 275,550 | 9/1984 | Johnson et al. | D8/331 |
| 3,527,489 | 9/1970 | Nemeth | 292/289 |
| 3,837,693 | 9/1974 | Adickes | 292/DIG. 20 |
| 3,927,906 | 12/1975 | Mieras | 292/DIG. 46 |
| 3,966,243 | 6/1976 | Connell | 292/40 |
| 4,061,372 | 12/1977 | Cardoso | 292/DIG. 46 |
| 4,135,376 | 1/1979 | Evans et al. | 70/100 |
| 4,295,676 | 10/1981 | Smith | 292/262 |
| 4,383,708 | 5/1983 | Lamberth | 292/DIG. 46 |
| 4,429,912 | 2/1984 | Smith, Jr. | 292/263 |
| 4,493,501 | 1/1985 | Abel | 292/263 |
| 5,542,721 | 8/1996 | Allen | 292/DIG. 47 |

*Primary Examiner*—Michael F. Trettel

*Assistant Examiner*—Robert G. Santos

*Attorney, Agent, or Firm*—Famiglio & Associates; Robert B. Famiglio, Esq.

[57] ABSTRACT

A rotatable security bar mechanism permanently attached to the frame of a slidable panel such as a patio door or window, capable of being operated without interfering with the normal operation of the panel or window, is disclosed. The pivoting security bar assembly includes a single bar section having generally rectangular dimensions and which are disposed to interfere with the direction of travel of a slidable panel or door in its normal operating direction. The Security bar rotates about hinges alternatively in an open and closed position to cover the slidable track area of the slidable or moveable panel member. When the bar is in the locked position, it covers slidable track members utilizing the shape, design, and trim levels which are similar to the design trim of the slidable panel or window units color and design, such as to be unnoticeable. The present disclosure also provides the application of the security bar mechanism to a double hung, slidable window design to provide enhanced security by providing a blocking means to the operation of the window. Also disclosed are certain and various enhancement of the locking mechanism to provide for additional security for the rotating security bar. The present invention also allows for ease of use by handicapped or sightless individuals, as well as individuals perhaps confined to a wheelchair.

4 Claims, 7 Drawing Sheets

SLIDING DOOR/WINDOW SECURITY DEVICE

BACKGROUND OF THE INVENTION

The present invention relates to a pivoting locking mechanism for sliding doors or panels, including windows, offering improved security by preventing operation of those windows when it is not desired by the owner or user. The disclosed invention provides simpler and improved function, as well as a more pleasing aesthetic application of security devices, unlike those provided and described in the prior art.

The problem which has existed for many years in the use of sliding doors and windows in homes, motels and office buildings is that of security. Locking mechanisms for sliding glass doors, as frequently used in patios or for entry to and from a deck, can be easily defeated. The locking mechanisms which are generally used attach the edge of the sliding panel to the door frame. In the past, it was a widespread practice to drop broomsticks or dowels into the sliding track mechanism to jam the operation of the slideable portion of the door or window, to prevent operation of the door if the latch mechanism is disabled. In an attempt to improve upon such a rudimentary form of locking mechanism, the prior art discloses various security locks for sliding doors which provide a means to prevent the sliding member of the door panels from operating, by blocking its direction of travel. Such devices are generally bar mechanisms which rotate or expand, to be placed in position somewhere along the broad end of the fixed panel of the slideable panel door combination. In essence, such mechanisms operate, generally speaking, in the same fashion as placing a wooden dowel across the direction of travel of the slideable panel.

Most of the prior art disclosures show security bar locking devices which hinge at one end, or at some other portion along the main bar member. Generally, the prior art discloses bars which rotate around the pivoting point of one end allowing the opposite end to secure firmly against the sliding glass door to be secured. The prior art alternatively describes improvements which are toggling pairs of bars which attach somewhere in the middle of a split member that provides for sliding or rotating means to bring the bar out of position to allow opening of the door. Yet other disclosures show removable means which clamp between the fixed end of the non-moving door in a slidable pair, and the frame of a moving slidable door. Such prior art inventions function as described by being in a position to place a normally applied force against the direction of travel of the sliding door to prevent the door from being forced opened or to otherwise reinforce the existing locking mechanisms. The prior art fails to disclose a simple mechanism which can be permanently attached to the sliding door or window members and which will pivot alternatively out of the way or into the operating position with few moving parts and using a design which can be easily adapted to generally match the trim and shape of the members which comprise the door unit or window unit being secured. Also, since commonly used security devices are hinged bars and described above, the bar only needs to be lifted from the retaining channel or fixing mechanism in order to open the door. Thieves have devised tools and are otherwise well skilled in means to accomplish this purpose of breaking-in, since it is well known that sliding glass doors are normally the preferred entry point for thieves or in other break-in activity.

SUMMARY OF THE INVENTION

The disclosed invention is a locking mechanism for a sliding door or window or a slidable panel which comprises at least one bar or rail member which can be readily translated about its transverse axis to alternatively block the slidable track means used by a sliding door or panel to open or close. The rail member may be rotated about a hinge or axis to allow the sliding panel or door to open by unblocking the rail or slidable means utilized by the sliding door or panel. In describing the purpose of the present invention and throughout the description, sliding doors and windows, as well as other panels which may or may not be used as a door or may not have glass frame therein, will be considered as equivalents.

The mechanism disclosed provides a means to enhance the security of conventional locking mechanisms used on sliding glass doors. By pivoting a rail-like device into the path of the sliding portion of the sliding glass door, it blocks travel, thereby preventing entry even if a conventional locking mechanism for a sliding door has been defeated through the use of crowbar or other tools frequently used to gain forced entry into a room. The bar is comprised of a shape which generally matches the trim and frame of the sliding glass door to allow for a good match in appearance and aesthetics. To allow operation of the sliding door, the rail member is simply rotated about one or more hinges as to prevent blocking of the slidable track used to guide the slidable portion of the door to the open position.

In an alternate embodiment, the rail member can be applied to a conventional double hung window sash, to prevent operation of the window by blocking the path of the slidable portions of the window sash. Through use of accessory locks within the rail member, an upper portion of a window sash can be secured using the pivoting member which blocks the travel of the lower inside portion of the window sash.

It is the object of the present invention to provide a locking mechanism for a slidable door or window which is inexpensive, simple to construct and has aesthetic appearance by generally matching the sliding door or window frame trim and appearance.

It is another object of the present invention to provide a locking mechanism for a sliding door or window which is simple to operate, is permanently attached to a portion of such door or window, cannot be easily defeated. It is yet a further object of the present invention to provide an alternate and backup security means to prevent the opening and closing of windows and slidable doors should the conventional or original locking mechanism fail. It is yet another object of the present invention to provide a locking mechanism for a sliding door or window which can be easily operated by handicapped individuals, wheelchair bound or blind individuals.

These and many other objects will become readily apparent to those skilled in the art upon reading the following detailed descriptions taken in conjunction with the drawings particularly illustrating the embodiments presented.

DETAILED DESCRIPTION OF THE INVENTION

Figure 1:
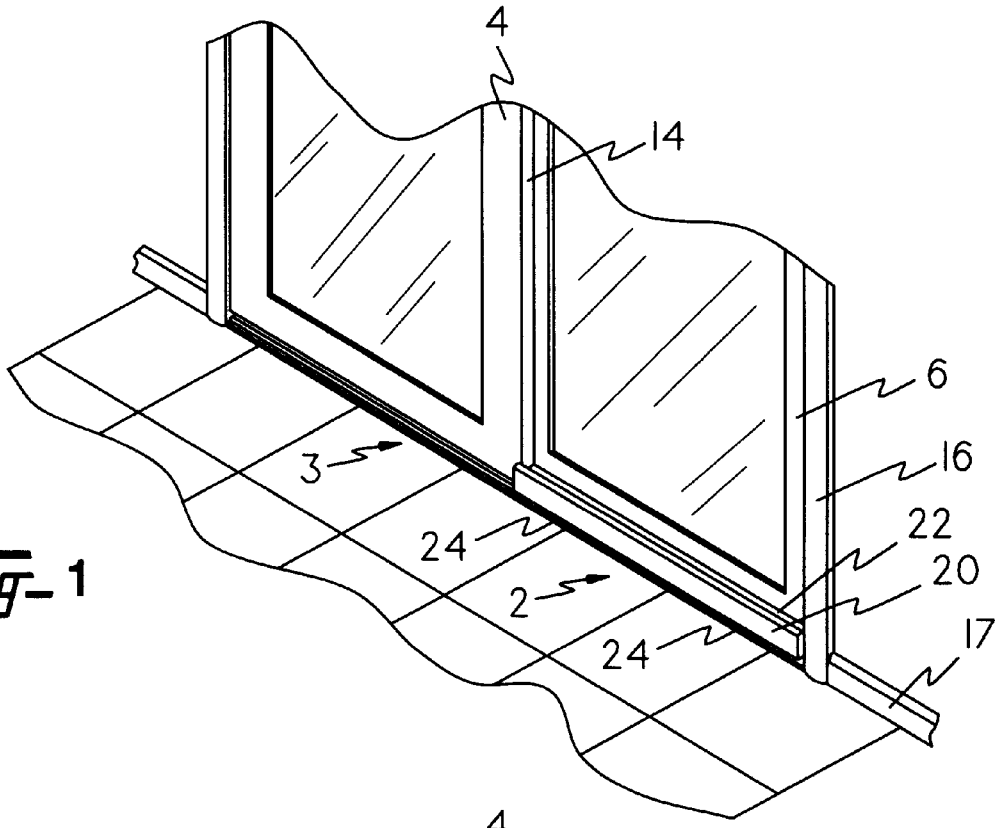
FIG. 1 is a broken away pictorial view of a sliding patio door locked in the closed position by the security device described in the first embodiment of the present invention.
Figure 2:
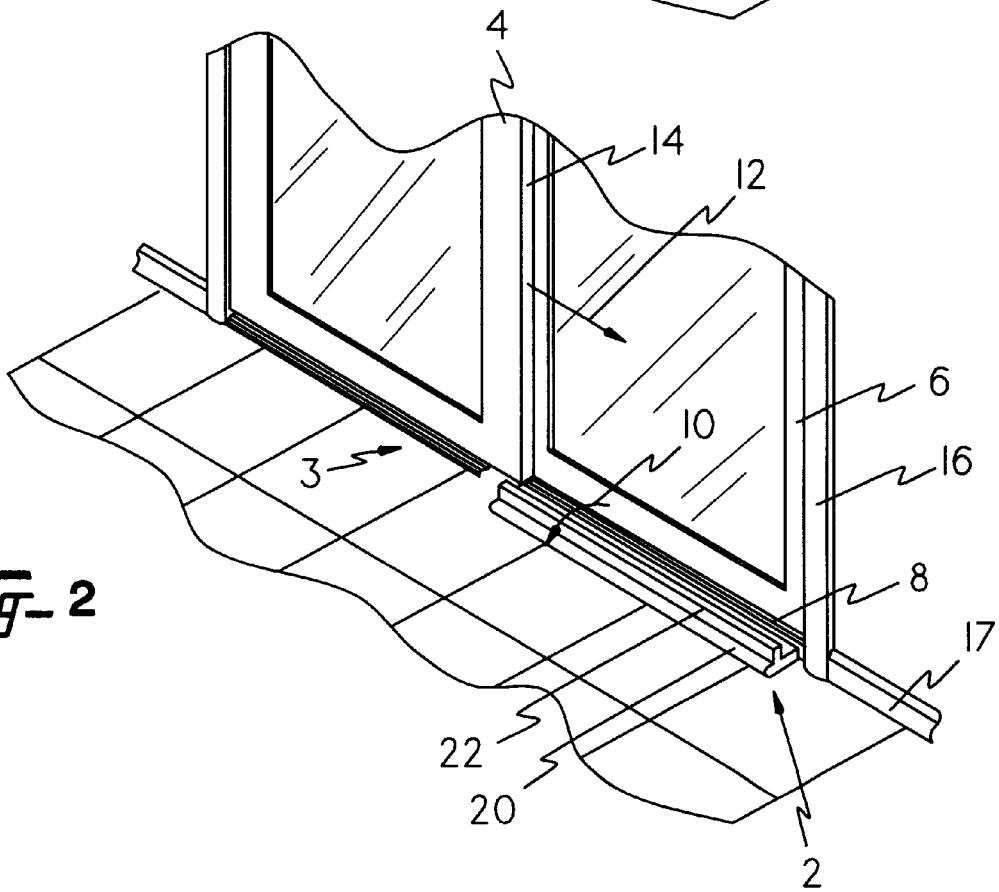
FIG. 2 is a broken away pictorial view of the sliding patio door shown in FIG. 1, with the first embodiment of the present invention in the unlocked position.

And now will be described in detail, specific embodiments of the invention, with particular reference to the drawings, wherein like parts are marked throughout the specification and drawing with the same reference numeral respectively. It should be noted that the drawings are not necessarily to scale, and in some instances, portions may have been exaggerated in order to more clearly depict certain features of the invention, as will hereinafter be more fully described. The main thrust of the invention is the use of a rail or bar which is placed in the track used as a sliding mechanism for a panel door, the type usually associated with a sliding patio door or other sliding glass windows. Rail 2, shown in its entirety in FIGS. 1 and 2 is a generally bar-like structure, which is alternatively placed into and away from the path and direction of travel 12 of sliding door 4. The entire sliding panel unit 3 can be a slidable door or window unit or two slidable panels, with or without glass, that serve as an entrance or exit portal or other opening to the outside of the home or building, or for any security area in which additional locking mechanisms are desired. Slidable door 4 operates on slide track 8 as shown in FIGS. 1 and 2 to move in direction 12 for purpose of gaining entry or exit through the slidable panel.

In the present art, fixed panel or door 6 is affixed permanently within the door frame shown generally in FIGS. 1 and 2, as well as in the other figures.

In the operation of sliding panel unit 3, the sliding panel or door 4 normally has a conventional locking mechanism which latches one side or part of door 4 into its frame or jam to prevent it from sliding open. To enhance the security of the unit 3, prior art auxiliary locking mechanisms have provided some type of bar or reinforcement means that prevent the sliding door 4 from traveling in direction 12 to be opened. Most frequently, a folding or removable security bar is placed between panel 4 and the edge of the fixed door 6, shown in the area of the door frame at 16, to provide a normally applied force counter to the direction of travel 12, thereby protecting against intruders using various mechanisms or means to defeat the conventional locking mechanisms utilized to prevent sliding door 4 from traveling in its operating direction along slide track 8.

Rail 2 is a generally rectangular bar-like structure, fabricated out of wood, plastic, metal or any material which matches the material used in the panel unit 3. Rail 2, which alternatively can be placed in the direction of travel of sliding door 4 by utilizing means to provide pivoting of the rail, usually hinges shown at 24 in the preferred embodiment. Rail 2 contains a rail face 20, and is designed to have a protruding rail block 22 which forms an inverted L-like structure as can be more fully appreciated by viewing the invention along its longitudinal axis with the cutaway views shown in FIGS. 3 and 4.

Figure 3:
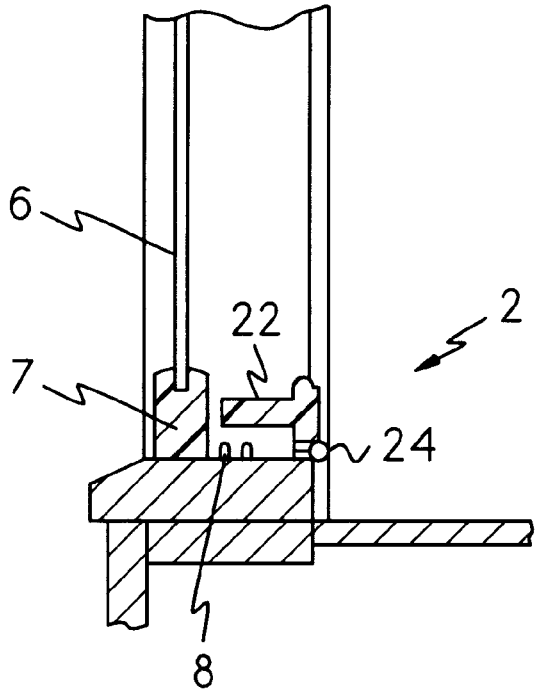
FIG. 3 is a semi-schematic cut away side view of the present invention and door panel depicted in FIG. 1.
Figure 4:
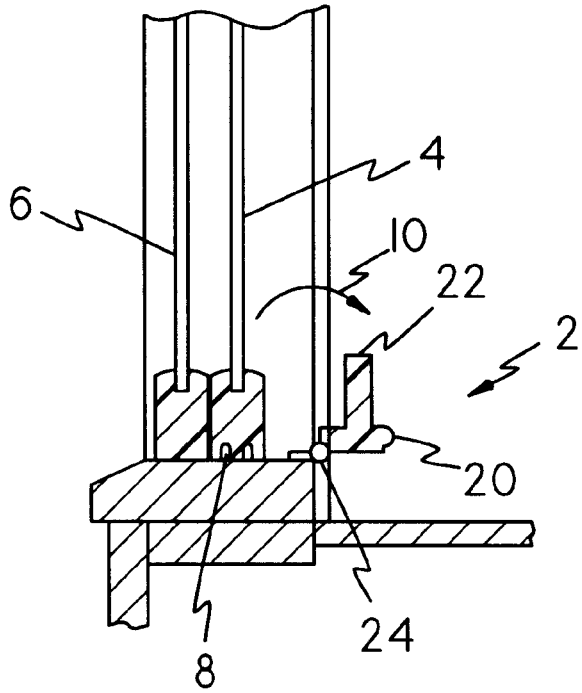
FIG. 4 is a semi-schematic cut away side view of the present invention, in the open position, depicted in FIG. 2.

With the rail in the upright position, shown in FIGS. 1 and 3, it can be observed that rail block 22 is located squarely within the travel direction 12 of sliding door leading edge 14. As would be further appreciated, rail 2 functions in a similar fashion as some of the prior art inventions, in that it prevents the travel of panel 4. However, rail 2 is designed to be permanently located generally adjacent to the fixed panel 6 of panel unit 3, normally at the bottom edge about the area of slide track 8, such that it may rotate in an arc shown at 10 as it pivots around hinge 24, so that sliding door 4 will be free to move in its normal direction 12 when rail 2 is in the down, or unlocked, position as shown in FIGS. 2 and 4.

Figure 5:
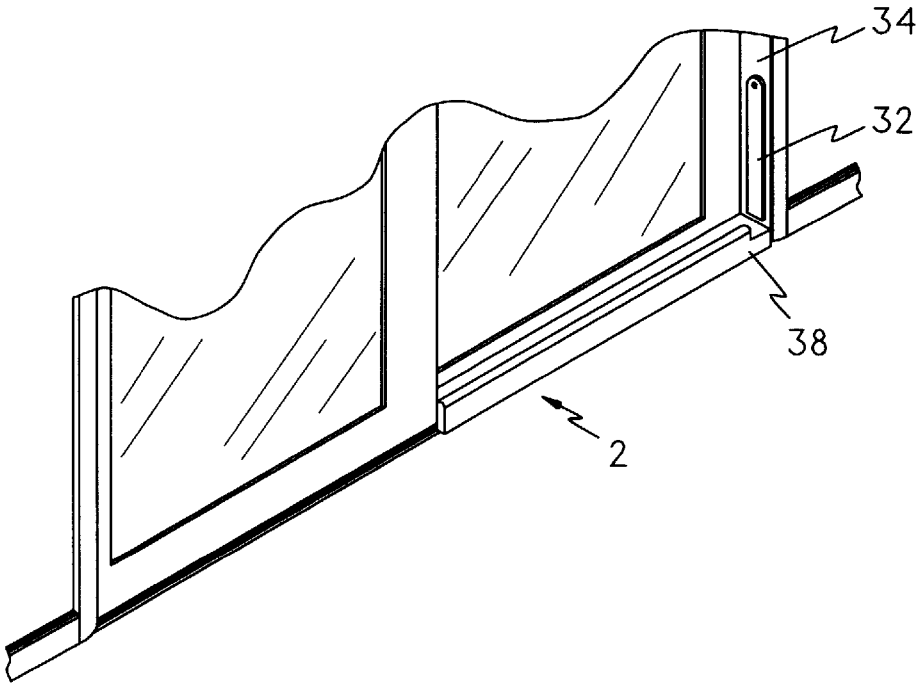
FIG. 5 is a broken away pictorial view of the present invention illustrating an accessory locking embodiment in the locked position.
Figure 6:
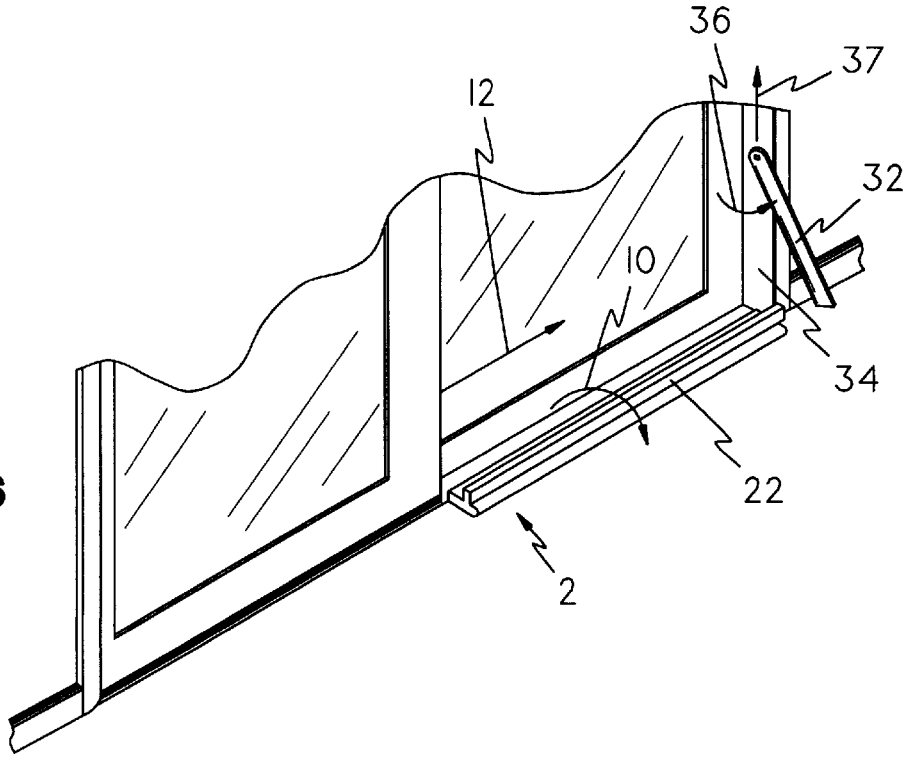
FIG. 6 is a broken away pictorial view of the present invention, depicting the alternative locking mechanism and the invention in the unlocked and opened position.
Figure 7:
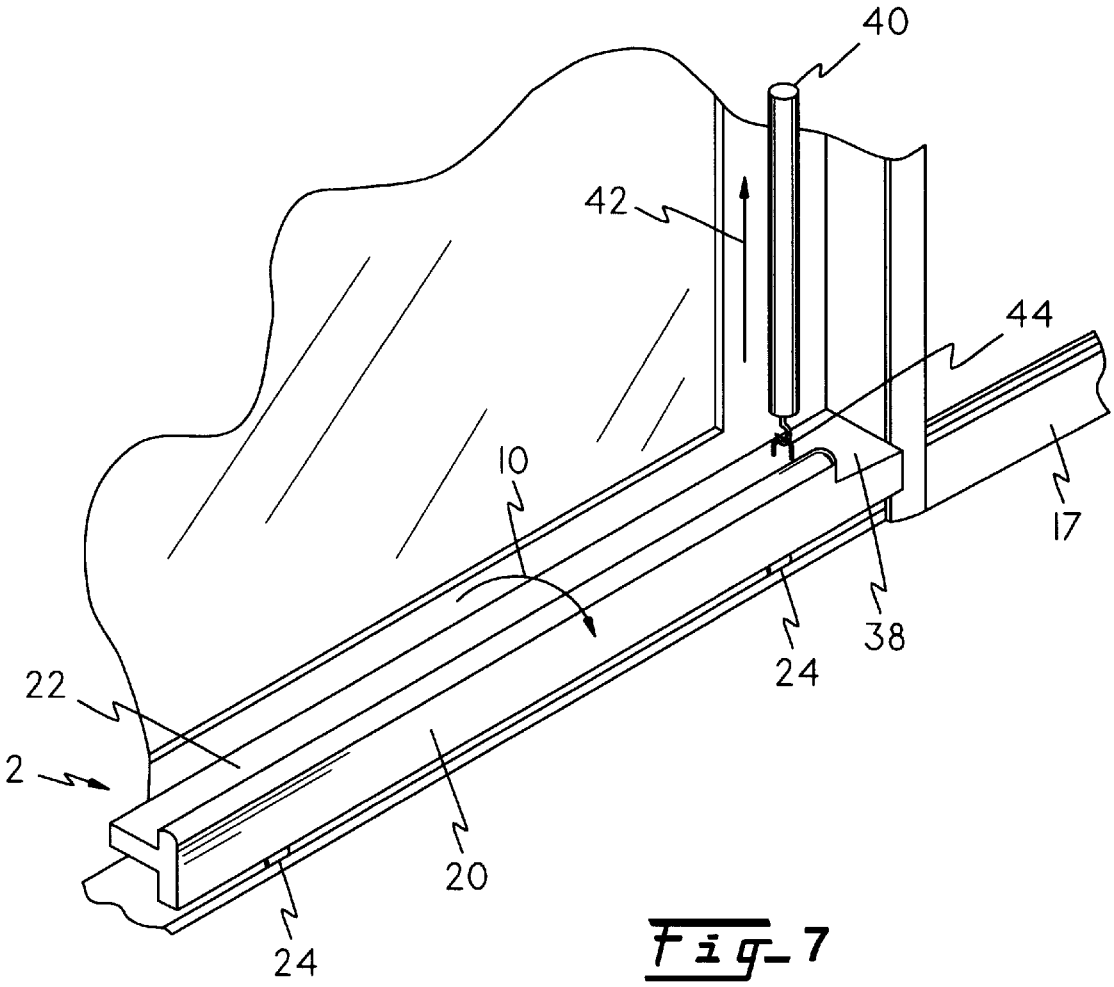
FIG. 7 is a broken away pictorial view, showing an enlargement of the present invention with the addition of a handicapped assist operating rod and further illustrating a notched out portion of the rail used with the security embodiment described in FIG. 5 and FIG. 6.

When rail 2 is in the upright and, therefore, locked position as shown in FIG. 1, it can be observed and appreciated from the drawings, that the shape, size and general trim configuration of rail 2 can be such as to provide a more pleasing match to the general design the panel unit 3 and/or the panel frame trim 16 shown in FIGS. 1 and 2, as well as FIGS. 5, 6, and 7. When applying rail 2, the design of the rail can be such that rail face 20 matches room trim 17 to a certain extent. Face 20 can be shaped, etched or otherwise painted and finished such that it has a more pleasing appearance when it is in the upright position as shown in FIG. 1, and is frequently unnoticeable to the casual observer. Unlike prior art metal bars which generally take the position in the center location of fixed door 6, (in the attempt to prevent slidable travel of sliding door 4), rail 2 is located in a position which provides a more difficult to observe presence. It is located such to provide for blending with the trim of the door, or at least conform to its general configuration. To the casual observer, rail 2 appears to be some type of fixed, permanent trim, which belongs in the position shown in FIG. 1, drawing no attention to its presence.

Rail block 22 which is situated at a 90 degree angle to the rail face 20, is designed to fit, generally speaking, flush along the top of slide track 8, therefore filling in the notched track units as if to appear to be a slidable-flat track and therefore an integral part of the track. This provides a more concealed locking unit, while at the same time presenting a pleasant appearance to the inside of the room. Users of the room, casually observing panel unit 3 with rail 2 in the upright and locked position, see what appears to be a general extension of the room trim 17 and frequently the door trim 16, depending upon the particular design and finish details of rail 2 for the application intended.

Turning to FIG. 3, it can be more fully appreciated, by studying the cut-away edge view shown, that rail block 22 can be designed to almost entirely cover track 8 and, if desired, may rest upon the fixed door frame 7.

In FIG. 4, it can be appreciated that in the open position, rail 2 can be designed such that rotated around hinge 24, face 20 may be used as a stop, thereby allowing rail 24 to stop in the position shown in FIG. 4 whereby rail block 22 is thereby disposed in the vertical direction. Block 22 and rail 2 also acts as a convenient handle to allow the operator of the mechanism to flip rail 2 back into the locked direction, acting as a toe board or toe catch. It has been observed that the present invention can be operated without the requirement that the person bend down to manipulate the device by hand. That is, a simple flip of one's foot allows for the convenient on and off operation, without the need to locate a bar to reach in a direction up or down or to operate the mechanism by unfolding or engaging the clasp or locking means, such as may be found in the prior art. Further, dogs that are trained to assist handicapped could operate the mechanism, if trained to do so.

It may be desired that an enhancement to prevent a would-be intruder to "jimmy" or otherwise manipulate the rail from the outside in some fashion, to cause it to rotate into the off position by travel in direction 10. FIGS. 5 and 6 demonstrate ancillary or accessory locking mechanisms which can further provide security should installation require such additional considerations. It would be appreciated that developing a slot 38 at the edge of rail 2 as shown in FIG. 5, locking lever 32, made of metal or wood, as may be desired, can be disposed to rotate about pivot 34 such as to slide or drop into slot 38 when rail 2 is in the upright and locked position. Pivot 34 can be designed to be a key hole or ratcheting mechanism which require travel in the upright direction 37 before it can rotate in direction 36 about pivot 34 for removal. However, the simplest configuration would provide for a swinging bar as generally depicted in FIGS. 5 and 6 whereby locking lever 32 simply rotates about pivot 34 without ratcheting mechanism or keyhole design to provide for vertical travel. In this simple configuration, slot 38 is comprised of a notched out portion of rail face 20 to allow lever 32 to be moved through the arc and direction depicted by direction 36 such that rail 2 can be moved in direction 10 as shown in FIG. 6. It will be appreciated by observation of the figures and by the general geometry involved in the movement of the elements described that rotation of rail 2 without prior movement with lever 32 will cause the rail to jam against lever 32 causing lever 32 to be forced in the upward direction 37. This is proven in practice to be a satisfactory method of preventing inadvertent rotation of rail 2 about it axis. In an alternative configuration to that shown in FIGS. 5 and 6, locking lever 32 prevents the rotation of rail 2 unless it is lifted in direction 37. Rotating rail 2 and direction 10 without the prior disengagement of locking lever 32 will cause lever 32 to jam the travel of the rail. The bottom of slot 38 attempts to both lift and rotate locking lever 34 in a direction other than that to be possible due to the directional design or the ratcheting mechanism which may be installed at pivot 34. It would appreciated by those skilled in the art that locking lever 32 can be of various designs, including cylindrical design, lateral latch-type design or other mechanisms which can be fashioned to prevent the rotation of rail 2 about the axis defined by hinge 24 or any device allowing the rotational means of the rail 2 to remove it from the path sliding panel 4. Further, the locking lever system could be helpful in preventing accidental opening by pets or small children.

It can also be appreciated that, although the convenience of rail 2 is such that it allows its rotation from the locked to released position around arc 10 to be a simple matter, there are those with disabilities and handicaps which may not be able to operate rail 2 as described above. It may be appreciated that those confined to a wheelchair, have arthritic conditions or other limitations which provide discomfort or render impractical to reaching the preferred location of rail 2, need additional assistance in order to operate the device. FIG. 7 shows one such embodiment of the invention which includes a means for a disabled operator to manipulate the device. Assist rod 40 can be attached to assist rod hook 44 for the purpose of expanding the locations in which an operator of rail 2 can provide the force or movement necessary to rotate the device into the unlocked or alternatively locked direction. Assist rod 40 can be a design of clear or finished plastic, metal or wood, depending on the appearance desired. In one example, assist rod 40 can match rod-like operating devices frequently employed on miniblinds which are occasionally used to decorate sliding door units. In any event, assist rod 40 can be affixed with velcro fasteners or other devices so that it remains available to the operator in the immediate vicinity of rail 2.

Figure 8:
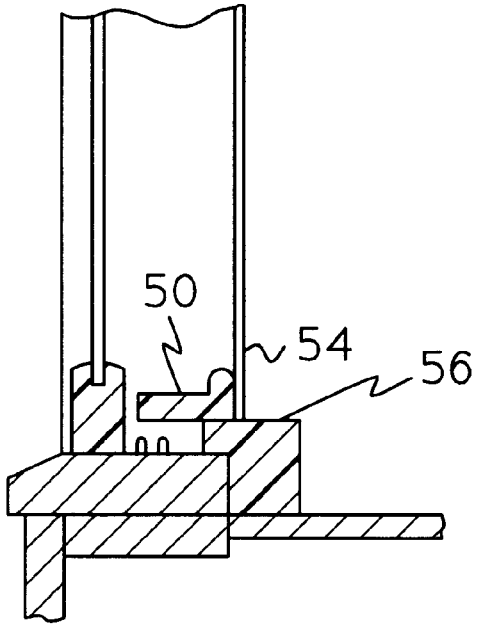
FIG. 8 is a semi-schematic cut away side view of an alternative embodiment of the invention showing the slidable locking means in the closed position.
Figure 9:
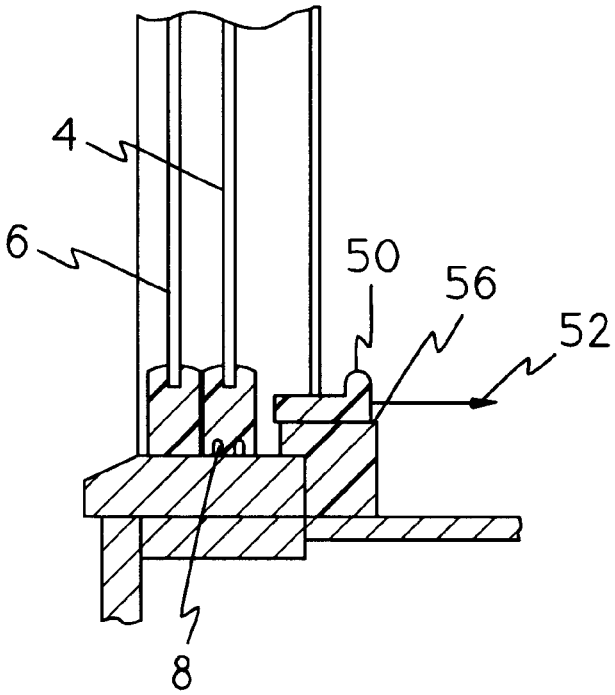
FIG. 9 is a semi-schematic cut away side view of an alternative embodiment of the invention showing the slidable locking means in the open position.

In a second embodiment of the invention, it can be appreciated by observing FIGS. 8 and 9 that rail 2 can be configured such that it no longer rotates about the axis defined by the hinge 24. Rather, alternative sliding rail 50 can be affixed above a sliding interface 56 which is comprised of slidable track units or longitudinally operating fixing means which will allow sliding rail face 54 to move in the direction illustrated to provide alternative blocking of the travel of sliding door 4. Shown in the closed or locked position of FIG. 8, sliding rail 50 is shown seated in a position similar to that taken by block 22 in FIG. 1 in the first embodiment. It can be appreciated by the cut-away end view shown in FIG. 8 that rail 50 interferes with the direction of travel of slidable door 4 by blocking its leading edge 14 shown in FIG. 1.

In this alternate embodiment, rail 50 can be unlatched or unlocked by moving it in direction 52 shown at FIG. 9 so that slidable panel 4 can travel in its operating direction 12. It can be appreciated by those skilled in the art that it would be a simple matter to add additional latching mechanisms to prevent rail 50 from sliding into the unlocked direction by attempts to defeat the mechanism using "jimmy" bars or other implements used in break-in situations.

Figure 10:
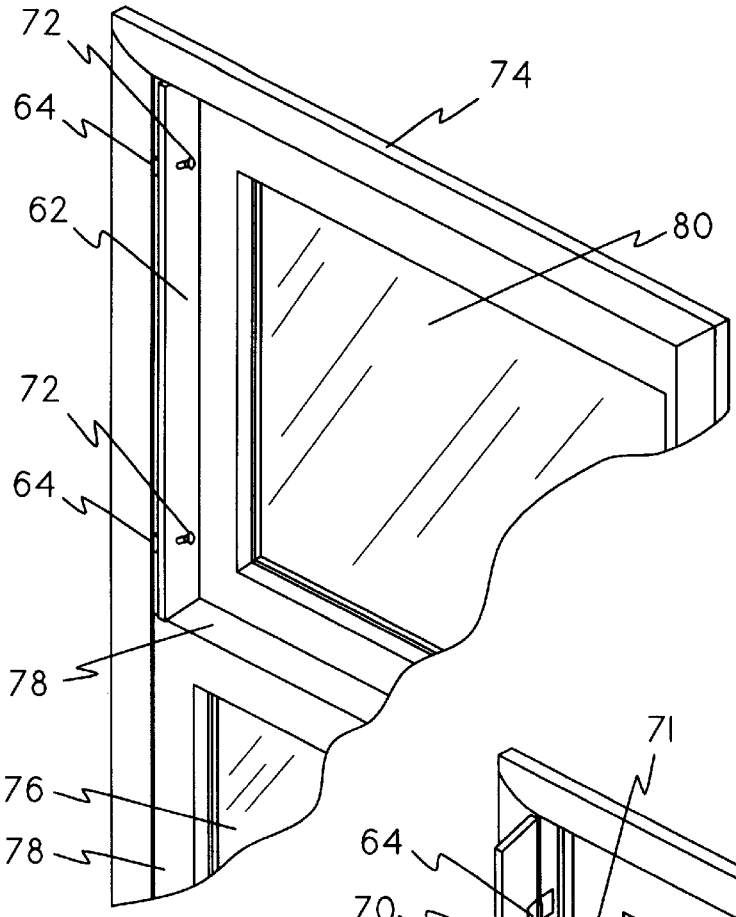
FIG. 10 is a cut away pictorial view of a window sash illustrating an alternative embodiment of the invention in the closed and locked position.

There is an additional application for rail 2 to be used, generally speaking, in the same application as the first embodiment applied to a slidable glass door. Double hung windows, shown in FIGS. 10 and 11, can equally benefit by the enhanced design shown by utilization of window bar 62. It will be appreciated that if one considers the invention shown in FIGS. 1 and 2, and rotates panel unit 3 90 degrees, the resulting operation of the slidable panels is almost identical of that of double hung windows. In a fashion similar to the prior art security devices used to prevent the forcible opening of sliding glass patio door units, homeowners and other building users have attempted to enhance the security of their double hung windows by placing wooden dowels, or other cylindrical or square elongated members in a location such as to prevent the travel of lower window sash 76 if the conventional latching mechanism has been broken or "jimmied". The alternate embodiment provides for window bar 62 to rotate about bar hinges 64 to prevent the upward travel of lower window leading edge 78 by simply blocking its path along one of its slidable tracks. While in the locked position as shown in FIG. 10, it can be appreciated that window bar 62 may be made of a material and trimmed in colors or shapes which are aesthetically pleasing by matching the color, wood trim, shape, or even the design of the window frame trim 74 or other structural members over the window. It can be appreciated that in the closed, locked position, as shown in FIG. 10, the presence of window bar 62 is not readily apparent to the casual or outside observer, when compared to other locking mechanisms, such as wooden dowels or broomsticks sometimes employed to prevent the upward travel of sash 76.

Figure 11:
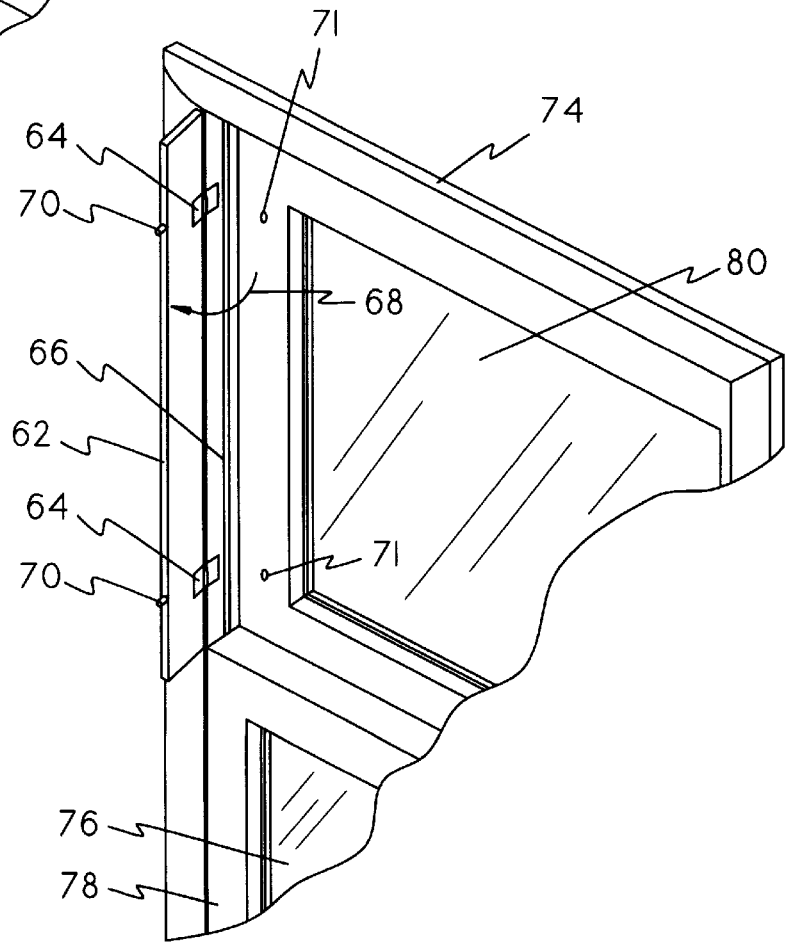
FIG. 11 is a cut away pictorial view of a window sash illustrating an alternative embodiment of the invention in the opened and unlocked position.

In the open position, shown in FIG. 11, the alternate embodiment simply rotated about hinges 64 in direction 68, allowing the free travel of lower window sash 76. In its open and unlocked position, it can be further appreciated that, after the window sash 76 is drawn upwards, window bar 62 can be rotated either out of the way by continuing in direction 68, assuming hinges 64 are disposed with 180 degrees of travel, or may be rotated back in the direction such as to partially or completely cover lower window sash frame face 78, depending on the aesthetics desired by the user.

Figure 12:
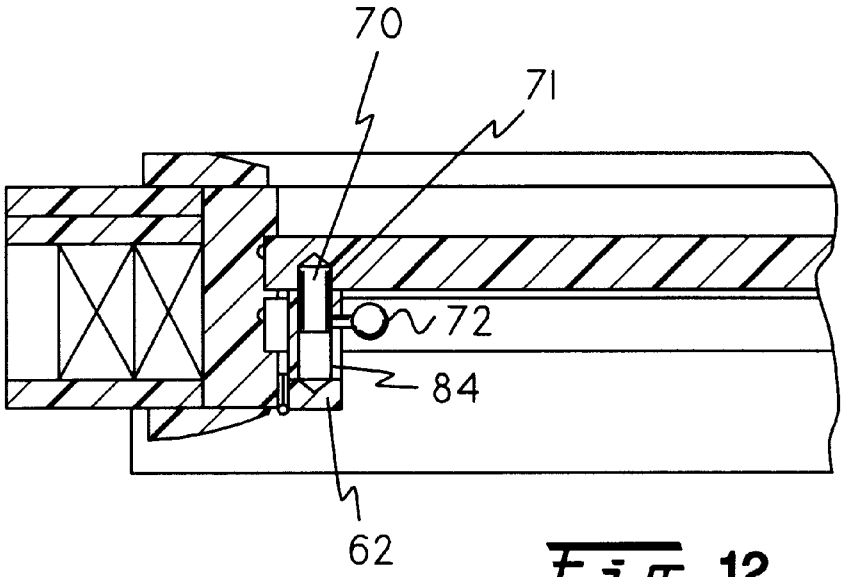
FIG. 12 is a cut away top view of the invention embodiment shown in FIG. 10, detailing the operation of the accessory locking means in the closed and locked position.
Figure 13:
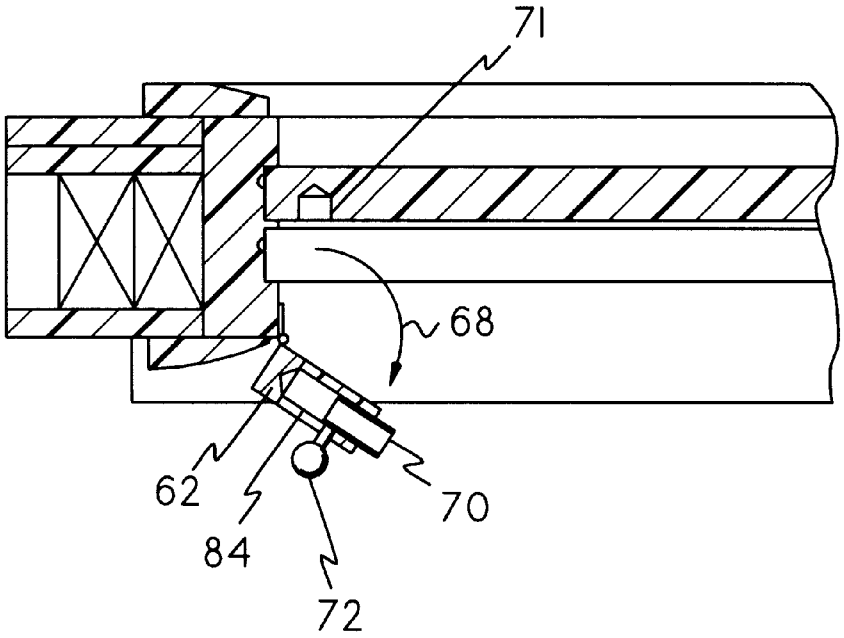
FIG. 13 is a cut away top view of the invention embodiment shown in FIG. 11, detailing the operation of the accessory locking means in the opened and unlocked position.

Just as in the first embodiment described for the slidable panel units in the present invention, additional security features and enhancements may be desired to apply the window frame unit shown in FIGS. 10 and 11, such as to prevent window bar 62 from being easily rotated, or prevent operation of the upper window sash. FIGS. 12 and 13 describe an additional enhancement mechanism when applied to the window bar 62 shown in FIGS. 10 and 11. FIGS. 12 and 13 show the top view, looking down, on the window sash shown in FIG. 10 and FIG. 11 respectively. FIG. 12 illustrates bar 62 in the closed, and therefore locked, position whereby pin 70 is firmly entrenched in notch 71 drilled into the window frame of window sash 80. It would be appreciated that these locking mechanisms could be affixed to the inside of bar 62 such as to allow knob 72 to protrude as illustrated in FIG. 10. In such a fashion, it would be a simple matter to operate knob 72 by moving it in a direction to withdraw pin 70 from notch 71 thereby freeing rail 62 to rotate in direction 68.

By the application of the locking mechanisms described in FIG. 12 and 13, it will be appreciated that both the top and bottom sash, therefore, cannot be operated without withdrawal of rail 62. Force is applied to pin 70, to allow it to remain seated in notch 71, by utilizing spring 84 which is concentric with the body of pin 70. Placing the locking mechanism described into the locked position, it will be appreciated that it is necessary to hold knob 72 in a retracted position, thereby impressing the spring in allowing the rotation of rail 62 into the closed direction. Thereafter, releasing knob 72 urges pin 70 into notch 71, once again locking sash 80 into position, as well as preventing lower window sash 76 from operating as earlier described.

It can be appreciated from the foregoing description and various embodiments provided that numerous changes or modifications may be made without the departing from the spirit or the scope of the invention as defined by the following claims. Although certain preferred embodiments are presented for the purpose of describing the applications of the present invention either presently manufactured by the inventor or otherwise shown to satisfactorily operate, other such species or derivations from the thrust of the invention presented are considered within the scope of the following claims.

What is claimed:

1. A locking means for preventing opening of a sliding panel along a slide track wherein the sliding panel is slidably mounted in a frame, said frame having at least two parallel vertical edges, said frame further having at least one sliding track mounted horizontally on the frame, said locking means comprising:

an elongated rigid rail member and mounting means for affixing said rail member horizontally to said frame in a first closed position in abutting engagement with a vertical leading edge of said panel, an adjacent frame vertical trim at the end of the sliding track, said end being parallel to and opposite the vertical leading edge of said slidable panel, wherein said vertical leading edge of said panel is the edge which is situated substantially equidistant from each parallel vertical edge of said frame when said panel is in the closed position, said mounting means including a hinge assembly for permitting a vertical swinging movement of said rail member from said first closed position to a second open position in disengagement from between the vertical leading edge of said slidable panel and said adjacent frame vertical trim to allow sliding of said panel in said frame, wherein further said rail member travels in an upward direction relative to the ground to be placed in said first closed position.

2. In combination with a sliding panel with a frame, said frame having at least two parallel vertical edges, said frame having a fixed panel adjacent and parallel to the sliding panel, a horizontal slide track below the sliding panel and at least one sliding panel on the track, said panel being capable of sliding horizontally along said track until one of said sliding panels vertical edges engages one parallel vertical edge of said frame, a locking means for said panel comprising:

an elongated rigid horizontal rail member; and mounting means for pivotally connecting said rail member to said slide track in a first closed position in abutting engagement between one vertical edge of said sliding panel and at least one parallel vertical edge of said frame, said mounting means providing for vertical swinging movement of said rail member from said first closed position to a second open position in disengagement from said one vertical edge of said sliding panel to allow horizontal sliding of said panel in said track, said mounting means rotating said locking rail member upward into said first closed position and supporting said rail member away from the said one edge of the sliding panel when in said second open position.

3. A locking means as recited in claim 2 wherein said hinge assembly comprises:

a lower surface rigidly attached to said frame along said frames lowest horizontal edge position between said two vertical edges, and said lower surface rigidly attached to said elongated rigid horizontal rail member by at least one hinge.

4. A locking means as recited in claim 2 wherein said elongated rigid rail member is dimensioned along a horizontal axis of said rail member such as to be substantially identical to the horizontal length of said fixed panel.

* * * * *